United States Patent [19]

Wu et al.

[11] Patent Number: 4,938,633

[45] Date of Patent: Jul. 3, 1990

[54] SEISMIC ISOLATION SYSTEMS WITH DISTINCT MULTIPLE FREQUENCIES

[75] Inventors: Ting-shu Wu, Downers Grove; Ralph W. Seidensticker, Wheaton, both of Ill.

[73] Assignee: The United States of America as represented by the Department of Energy, Washington, D.C.

[21] Appl. No.: 339,457

[22] Filed: Apr. 14, 1989

[51] Int. Cl.[5] ..... E04H 9/02

[52] U.S. Cl. ..... 405/229; 52/167 R

[58] Field of Search ..... 405/229, 230; 52/167, 52/167 CB, 167 DF

[56] References Cited

U.S. PATENT DOCUMENTS

| | | | |
|---|---|---|---|
| 4,474,508 | 10/1984 | Vos et al. | 52/167 X |
| 4,474,729 | 10/1984 | Schoening et al. | 52/167 X |
| 4,565,039 | 1/1986 | Oguro et al. | 52/167 |
| 4,599,834 | 7/1986 | Fujimoto et al. | 52/167 |
| 4,662,133 | 5/1987 | Kondo | 52/167 |
| 4,707,956 | 11/1987 | Sato | 52/167 |
| 4,830,927 | 5/1989 | Fukahori et al. | 52/167 X |

FOREIGN PATENT DOCUMENTS

| | | | |
|---|---|---|---|
| 2328810 | 5/1977 | France | 52/167 |

*Primary Examiner*—Dennis L. Taylor
*Assistant Examiner*—J. Russell McBee
*Attorney, Agent, or Firm*—Mark P. Dvorscak; Robert J. Fisher; William R. Moser

[57] ABSTRACT

A method and apparatus for isolating a building or other structure from seismic vibratory motion which provides increased assurance that large horizontal motion of the structure will not occur than is provided by other isolation systems. Increased assurance that large horizontal motion will not occur is achieved by providing for change of the natural frequency of the support and structure system in response to displacement of the structure beyond a predetermined value. The natural frequency of the support and structure system may be achieved by providing for engaging and disengaging of the structure and some supporting members in response to motion of the supported structure.

6 Claims, 3 Drawing Sheets

SEISMIC ISOLATION SYSTEMS WITH DISTINCT MULTIPLE FREQUENCIES

CONTRACTUAL ORIGIN OF THE INVENTION

The United States Government has rights in the invention pursuant to Contract No. W-31-109-ENG-38 between the U.S. Department of Energy and the University of Chicago.

BACKGROUND OF THE INVENTION

The present invention relates generally to a method and apparatus for supporting a structure such as a building, bridge, or power plant such that it is isolated from seismic vibratory ground motion. More particularly, the present invention relates to a method and apparatus for supporting a structure by an isolation system which will not allow large dynamic loads to be transmitted to the supported structure due to seismic motions which have damaging energy at frequencies at or near the natural frequency of the structure and the overall structural systems.

Two methods are used to prevent damage to buildings and other structures due to vibratory ground motion of seismic events. One method, the current conventional approach, is to embed the base of the structure onto firm soil and construct the structure to withstand seismic motion by providing adequate strength, rigidity and ductility. Use of this conventional method may incur significant costs of construction. In addition, it permits the seismic motion to be passed upward through the structure with resulting amplification of seismic accelerations and forces, thus requiring further precautions to prevent possible injury or death to occupants and costly damage to contents. The second method for preventing structural damage due to seismic events commonly known as seismic isolation, diminishes the seismic forces passed on throughout the structure, i.e. it decouples the structure from the earthquake ground shaking by supporting the base of the structure on a system of isolator bearings, which are, in turn, supported by a lower foundation mat, which is embedded upon the soil or rock.

The seismic isolation method of protecting a structure and its contents from seismic motion is based on the response of structures to vibrating motion at the base of the structure. If the fundamental natural frequency of the support and structure is sufficiently below the dominant or high energy content frequencies of the seismic motion, the structure will be subjected to greatly reduced seismic loading as compared to the more conventional method. Historical records of many damaging earthquakes in the world show that the seismic motion is observed to have most of the damaging potential energy at frequencies between 1 and 10 Hz. At the present time, seismic isolation systems are typically designed to create a support and structural system which has a natural frequency of less than 1.0 Hz, in some cases as low as 0.1 Hz.

Structures and equipment and others contents within the structure are generally more susceptible to damage from seismic motion in the horizontal plane than in the vertical direction. A common practice in seismic isolation design, therefore, is to isolate the structure from ground motion only in the horizontal plane. This isolation is achieved by supporting the structure by isolator bearings which, with the structure, form a dynamic system that has a horizontal natural frequency much lower than the non-isolated structure. The vertical natural frequency is usually designed to be very high, and is greater than the dominant frequencies of the vertical seismic ground motion. The structure will consequently not be significantly excited by the expected seismic event; it is noted, however, that certain portions of the structures such as beams and slabs, and certain equipment or other contents within the structure may have lower natural frequencies, and may be subjected to the same amplified considerations and loads experienced in the conventional design method.

Structures and in particular, components and systems contained within the structures, that are inherently susceptible to damage due to excitation by seismic motion are most efficiently protected by the isolation method. An example of this is a Nuclear Liquid Metal Reactor (LMR) vessel which is a thin walled structure having low natural frequencies and is therefore susceptible to seismic damage. The reactor vessel is a critical component of the reactor which must be reliably protected from earthquakes. Isolation of the reactor as a means of protecting it from damage must be achieved with a high degree of a reliability to assure safety of the LMR. Other highly critical facility examples include emergency facilities such as hospitals, in which many items of equipment as well as staff and patients are mobile and very vulnerable to horizontal seismic forces.

The frequency content of seismic motion at a given site is dependent on a variety of variables such as the geology of the site and consequently is best described as random. As a consequence, seismic motion that has significant energy at or near the isolation frequency is a possibility.

Therefore, in view of the above, an object of the present invention is to provide a method and apparatus to isolate a structure from seismic motion that will not allow large seismic loads to be transmitted to the structure. Another object of the present invention is to increase the assurance that an isolation system will not allow large seismic loads to be passed to a structure beyond that provided by isolation systems that do not provide for significant alteration of the natural frequency of the structure and isolation system. Additional objects, advantages and novel features of the invention will be set forth in part in the description that follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects in accordance with the purposes of the present invention, as embodied and broadly described herein, the invention may comprise a generally horizontal lower mat that may be embedded in soil or otherwise provide support, an upper mat that is vertically adjacent to the lower mat which is an integral part of the supported structure and is the only location of support of the structure, and a plurality of structural isolator bearings each coupled to the upper and lower mats. At least one structural isolator is rigidly coupled to the upper and lower mats, primary isolator bearing, and at least one structural isolator is rigidly coupled to one mat and coupled to the other mat by a means to allow engagement and disengagement or slippage of the mat and isolator as a result of relative displacement of the upper and lower mats, secondary isolator bearings.

The present invention provides assurance that large horizontal motion of the structure will not occur by providing a means for changing the natural frequency of the support and structure system in response to relative horizontal displacement of the upper and lower mats that is caused by seismic motion near the natural frequency of the support and structure system. Maintaining a separation between the dominant frequency of the seismic motion and the natural frequency of the structure and support system provides greater assurance of safety than is provided by isolation system which have a single natural frequency.

BRIEF DESCRIPTION OF THE DRAWINGS

The present invention is illustrated in the accompanying drawings wherein.

DETAILED DESCRIPTION OF THE INVENTION

The present invention which isolates a structure such that it will not experience large horizontal seismic load due to seismic motion at or near the natural horizontal frequency of the support and structure system comprises changing the horizontal natural frequency of the support and structure system as a result of relative horizontal displacement of the structure and lower mat that is larger than a predetermined value, or as a result of the shear force transmitted through the isolator exceeding a predetermined value. The predetermined displacement or shear force value is selected to be a value that is greater than the maximum value that would be expected due to seismic load at a frequency that is not at or near the natural frequency of the support and structure system. By shifting the horizontal natural frequency of the support and structure system in response to larger than expected isolator bearing shear force or relative displacement of the structure and lower mat, the relative displacement or transmitted shear force will be limited to a value that results from seismic motion at a frequency that is separated from the natural frequency of the support and structure system.

Figure 1:
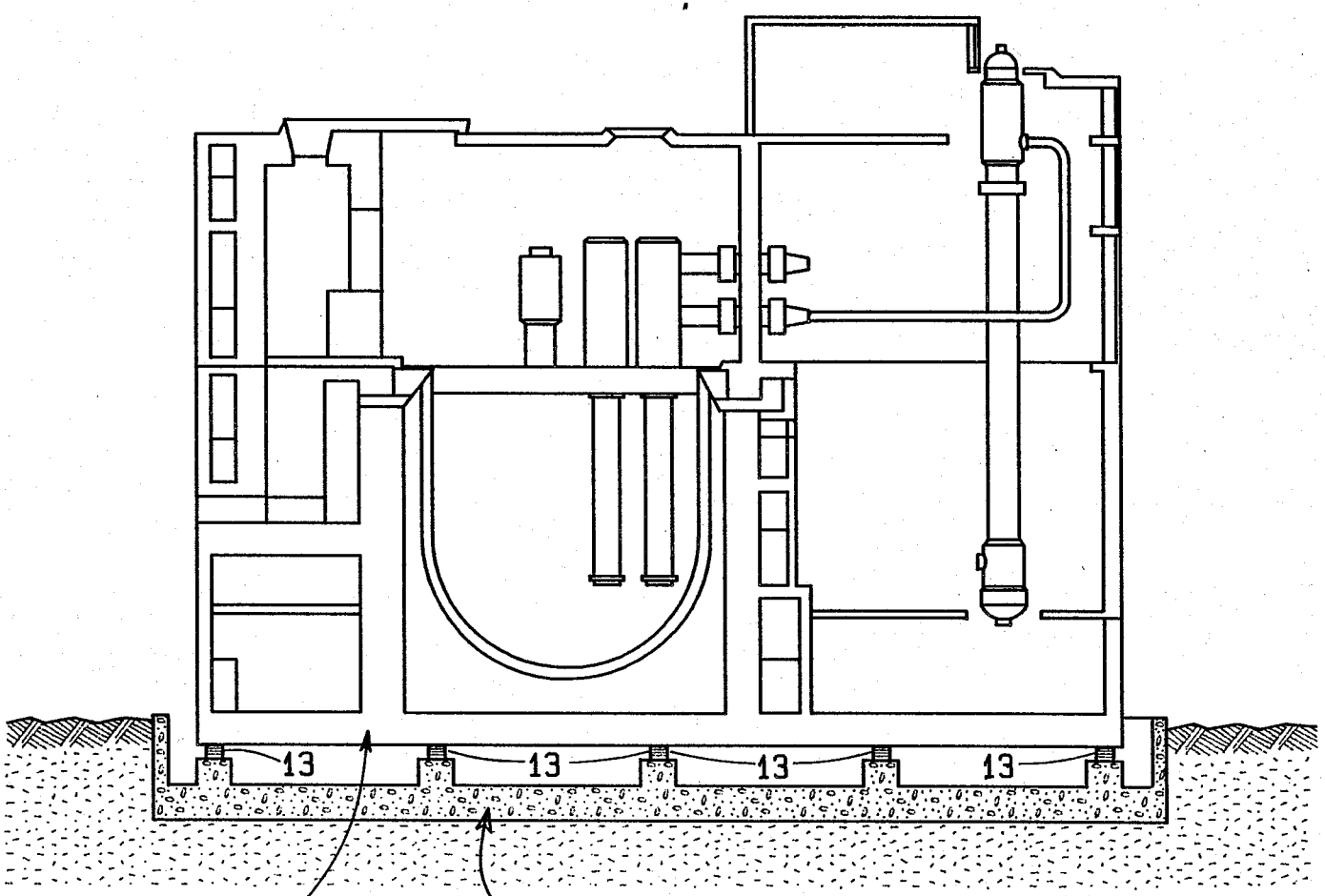
FIG. 1 is an elevation view of a nuclear island containing a critical facility which is supported by structural isolator bearings.

The present invention, as illustrated in FIG. 1, comprises supporting a structure on isolator bearings, 13, which are coupled to the upper mat of the structure, 11, and a soil embedded lower mat, 12. Isolator bearings that are rigidly coupled to the upper and lower mats are primary isolator bearings. Primary isolator bearings always support the structure and contribute to support stiffness in both vertical and horizontal directions. Isolator bearings that are rigidly coupled to one mat and may engage and disengage or slip with respect to the other mat are secondary isolator bearings. Secondary isolator bearings' contribution to horizontal stiffness is dependent on the relative motion of the upper and lower mats as illustrated by embodiments described below. Vertical support of the structure by secondary isolator bearings is a result of the requirements of the embodiment of the invention. Contribution to horizontal stiffness of the support of the structure by secondary isolator bearings, and the consequent alteration of the natural frequency of the support and structure system, in response to relative horizontal motion of the mats or shear force in the secondary isolator bearings form the basis of the embodiments of the present invention.

The upper and lower mats may be any structural material which will support the structure. Concrete is commonly used for structures of the type that are likely to be supported by the present invention. Structural steel is a commonly used material for support of structures, either alone or in combination with concrete. Use of steel in combination with concrete as reinforcement and as attachments to concrete such as embedded plates is well known and governed by standard practices and structural standards. Structural isolator bearings of various construction have been used for seismic isolation. A description of the design of a building's seismic isolation system with a natural frequency of 0.5 Hz is described in Megget, "The Design and Construction of a Base-Isolated Concrete Frame Building in Wellington, New Zealand", Proceedings of the Eighth World Conference on Earthquake Engineering, Volume 5, 1984, Prentice Hall, Inc.

Figure 2:
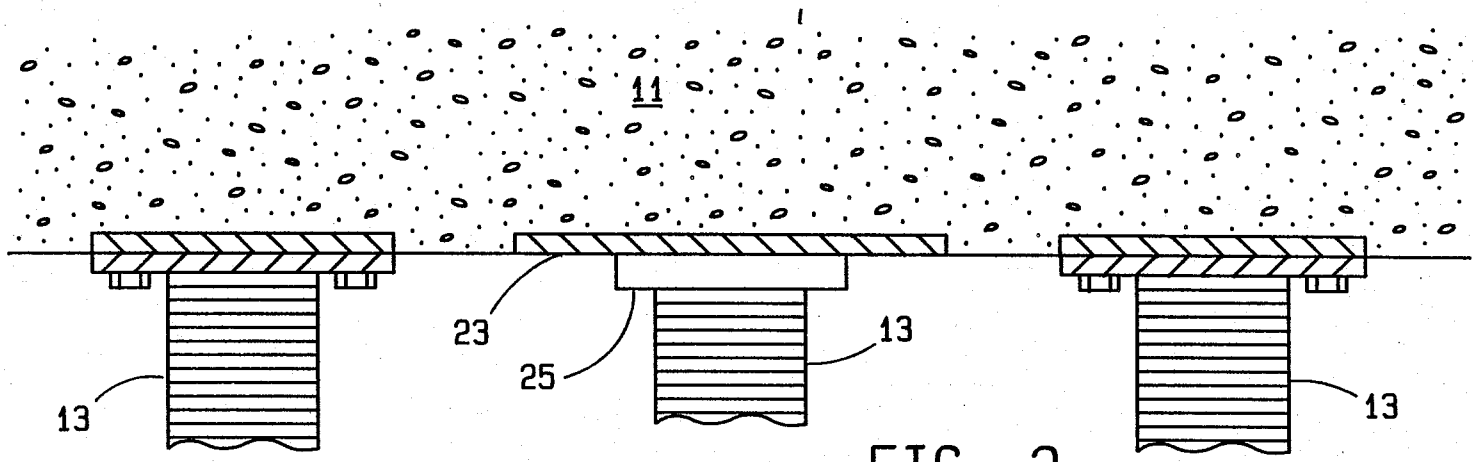
FIG. 2 is an illustration of a frictional contact embodiment of the invention which allows slippage of a structural isolator bearing and a mat in response to large shear force.

The apparatus which allows slippage of an isolator bearing and a mat due to transmitted shear force may comprise two contact pads, 23 and 25 of FIG. 2, one anchored to a mat as illustrated by the upper mat, 11, and one anchored to an isolator bearing 13. The contact pads abut each other with generally flat horizontal surfaces which transfer vertical load through the isolator bearing, 13. The contact pad material and surfaces and the vertical load carried by the contact pads are specified so that horizontal slippage of the contact pads will occur when horizontal shear forces exceed a design value. The design value is specified to correspond to the force of the isolator bearing due to horizontal relative displacement of the upper and lower mats that is greater than expected to occur due to seismic motion at a frequency which is separated from the natural frequency of the structure and support system.

The contact pad embodiment of the present invention may be practiced by use of design and construction methods that are well known. As an example, for a maximum transmitted shear force $F_{max}$, the materials and surfaces of the contact pads must be specified so that slippage will occur for that value. Static coefficients of friction for various material pairs and surfaces are given in standard handbooks. The vertical load carried by the isolator $F_v$ is a known design variable. Any materials that will support the vertical load and whose static coefficient of friction is $F_{max}/F_v$ will satisfy the maximum shear force criteria. Attachment of the contact pads to the isolator bearing and mat may be accomplished by the types of attachment that are used for conventional systems as illustrated by Megget.

A system of primary and secondary isolator bearings which includes the contact pad embodiment of the present invention may comprise equal numbers of primary and secondary isolator bearings or may be combined in any ratio to such anticipated seismic motions. In a system with equal numbers of primary and secondary isolator bearings which have the same stiffness, the relationship between the horizontal natural frequency of the structure and support system with no slippage of contact pads, $F_1$, and with slippage of the contact pads, $F_2$, is $F_2=F_1/2^{\frac{1}{2}}$. For a system designed for $F_1=0.5$ Hz this relationship gives $F_2=0.35$ Hz. Similarly, a system designed for $F_1=0.75$ Hz gives $F_2=0.53$ Hz The apparatus which engages and disengages an isolator bearing and a mat due to horizontal relative displacement of the upper and lower mats, FIG. 3, may comprise two concentric cylinders with generally vertical axes, 33 and 35, one anchored to a mat as illustrated by the upper mat, 11, and one anchored to an isolator bearing, 13. The axes of the cylinders are coincident when the upper and lower mats are not displaced. The inner radius of one cylinder is larger than the outer radius of the other cylinder by the dimension of the greatest horizontal relative displacement of the upper and lower mats which is tolerated before engagement of the isolator. The cylinders are constructed to be much stiffer than the isolator bearing. Structural steel may be used for construction of the cylinders so that attachment to the mat and isolator bearing may be accomplished by known means. The configuration of FIG. 3 may be reversed so that the smaller diameter cylinder is anchored to the mat and the larger diameter cylinder is anchored to the isolator bearing. Two embodiments of the cylinder embodiment may be implemented. The opposing end surfaces of the cylinders may be separated such that the contact only occurs at the radial surfaces of the cylinders. Relative horizontal displacement of the upper and lower mats causes the mats to move closer to each other. The opposing end surfaces of the concentric cylinders maybe separated when the upper and lower mats are not displaced and such that contact of the end surfaces will occur before engagement of the radial surfaces of the cylinders. The materials and surfaces of the cylinder end surfaces may be specified so that a desired horizontal load is transmitted due to friction of the end surfaces before engagement of the cylinders as described for the contact pad embodiment of the invention.

A system of primary and secondary bearings which includes the cylinder embodiment of the present invention, may comprise equal numbers of primary and secondary isolator bearings which have the same stiffness. The relationship between the horizontal natural frequency of the structure and primary isolator bearings, $F_1$, and the horizontal natural frequency of the structure and primary and secondary isolator bearings, $F_2$, is $F_2=F_1 2^{\frac{1}{2}}$. For a system designed for $F_1=0.5$ Hz, this relationship gives $F_2=0.71$ Hz. Similarly, a system designed for $F_1=0.75$ Hz, gives $F_2=1.06$ Hz.

Figure 3:
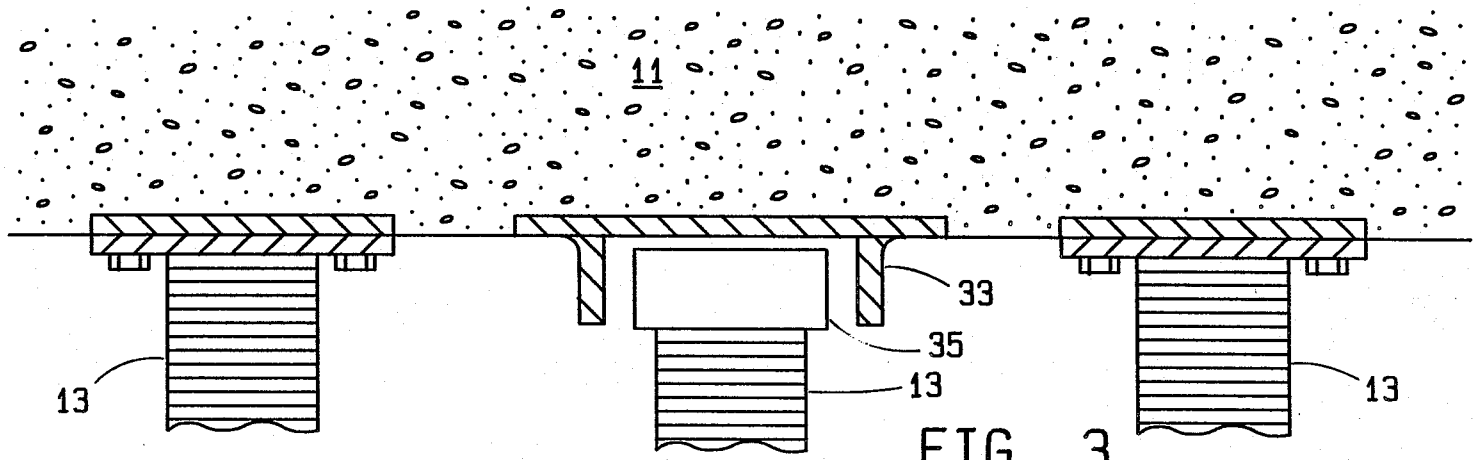
FIG. 3 is an illustration of a gap and contact embodiment of the invention for engaging a second structural isolator bearing and a mat in response to large horizontal relative displacement. These isolator bearings do not provide any horizontal resistance until such large displacements occur.
Figure 4:
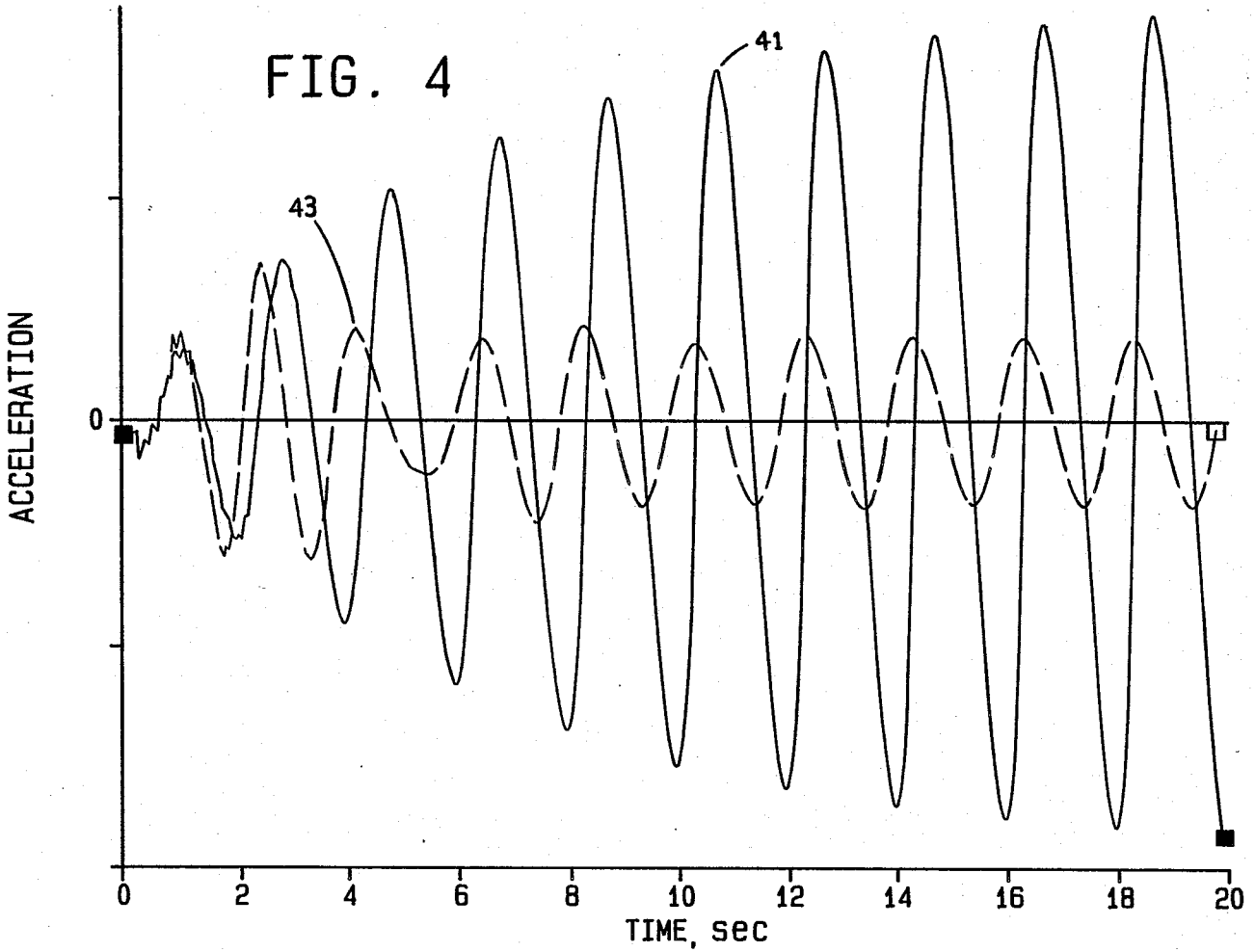
FIG. 4 is an illustration of the acceleration response of a structure, supported in one case by a single frequency isolator system, 41, and in another case by a multi frequency isolator system, 43, that are subjected to single frequency motion.

FIG. 4 illustrates the response of a structure supported by a system of isolators so that the structure and isolator system has a natural frequency of 0.5 Hz, 41, and the response of a structure supported by primary isolators which from a system with the structure with a natural frequency of 0.5 Hz and secondary isolators embodying the present invention as shown in FIG. 3 which have the same stiffness as the primary isolators, 43. Both responses are the result of motion at 0.5 Hz. As illustrated by that Figure, the acceleration of the structure supported by the single frequency isolator system will become larger for each cycle while the multi-frequency isolator system limits the acceleration. FIG. 4 illustrates a significant difference in acceleration of the structures supported by the two systems after 3 to 4 cycles at the fundamental natural frequency. The results illustrated by FIG. 4 illustrate the additional assurance of low acceleration that is achieved by the present invention.

The embodiments of this invention in which an exclusive property or privilege is claimed are defined as follows:

1. A method for supporting a structure such that it is isolated from seismic vibratory ground motion comprising:

supporting the structure by a horizontal upper mat;

providing a lower mat vertically adjacent to the upper mat of the structure that can support the structure;

creating a structure and support system that has a characteristic frequency that is outside the range of expected frequencies of seismic vibratory motion by coupling the upper and lower mats rigidly with primary isolator bearings, and altering the characteristic frequency of the structure and support system by coupling secondary isolator bearings rigidly to one of said upper or lower mats and movably to the other of said upper or lower mats to engage and disengage the secondary isolator bearing and the other mat in response to seismic vibratory motion.

2. A system for isolating a structure from vibrating motion of seismic events comprising:

a generally horizontal upper mat that is an integral part of the structure;

a generally horizontal lower mat that can support the structure and is vertically separated from the upper mat;

a combination of a plurality of primary and secondary structural isolator bearings interposed between the upper and lower mats;

said primary bearing supported the structure and being rigidly coupled to the upper and lower mats, said primary bearings and structure having a first natural frequency;

said secondary beam bearings being rigidly coupled to one of said upper or lower mats, and movably coupled to the other of said upper or lower mat;

said secondary bearings supporting the structure in combination with the primary bearings only during relative horizontal movement of said upper and lower mats in response to seismic motion, whereby the first natural frequency of the combination of bearings and said structure is changed to a second natural frequency.

3. The system of claim 2 wherein the secondary isolator bearings are movably coupled to the other of the upper or lower mats by two contact pads, one rigidly attached to the secondary structural isolator bearing and one rigidly attached to the mat such that the contact pads about each other with generally flat horizontal surfaces which slip with respect to each other due to horizontal relative displacement of the upper and lower mats.

4. The system of claim 2 wherein a secondary isolator bearing and one of said upper or lower mat engage and disengage by two concentric cylinders having opposing end surfaces and radial surfaces which are separated, and also having generally vertical axes which are coincident when the upper and lower mats are horizontally undisplaced, one cylinder is rigidly connected to one of the mats and one cylinder is rigidly connected to the structural isolator bearing, and the outer radius of one cylinder is smaller than the inner radius of the other cylinder by the dimension of the largest horizontal relative displacement of the upper and lower mats that is allowed before engagement of the isolator bearing, whereby the radial surfaces of the cylinders contact due to relative displacement of the upper and lower mats caused by seismic motion and the opposing ends of the cylinders are separated so that the radial surfaces of the cylinders are the only location of contact of the cylinders due to relative displacement of the upper and lower mats.

5. The system of claim 2 wherein a secondary isolator bearing and one of said upper or lower mat engage and disengage by two concentric cylinders having adjacent, opposing end surfaces, radial surfaces, and generally vertical axes which are coincident when the upper and lower mats are horizontally undisplaced, one cylinder is rigidly anchored to the mat and one cylinder is rigidly anchored to the structural isolator bearing, and the outer radius of one cylinder is smaller than the inner radius of the other cylinder by the dimension of the largest horizontal relative displacement of the upper and lower mats that is allowed before engagement of the isolator bearing and the adjacent end surfaces of the cylinders comprise generally flat horizontal surfaces which are separated when the structure is undisplaced by an amount which will result in contact of the end surfaces due to horizontal relative displacement of the upper and lower mats caused by seismic motion, and before the radial surfaces contact each other.

6. The system of claim 2 which comprises equal numbers of primary and secondary isolator bearings.

* * * * *